United States Patent [19]

White

[11] Patent Number: 4,689,911

[45] Date of Patent: Sep. 1, 1987

[54] GRENADE LAUNCHER ATTACHMENT FOR INFANTRY WEAPON

[75] Inventor: Bernard C. White, Robbinsdale, Minn.

[73] Assignee: Napco Industries, Inc., Hopkins, Minn.

[21] Appl. No.: 617,264

[22] Filed: Jun. 4, 1984

[51] Int. Cl.[4] ..... F41C 21/18; F41F 1/06; F41F 19/02

[52] U.S. Cl. ..... 42/105; 42/1.06; 89/177; 89/178; 89/198; 89/43.01

[58] Field of Search ..... 42/1 F, 1 V, 1 S, 86, 42/74, 105, 1.06, 100; 102/483; 89/1.3, 1.35, 177, 178, 198, 42.01, 43.01

[56] References Cited

U.S. PATENT DOCUMENTS

| | | | |
|---|---|---|---|
| 2,422,767 | 8/1943 | Anderson | 89/198 |
| 2,883,781 | 4/1959 | Harvey | 42/1 F |
| 2,900,877 | 8/1959 | McClenahan | 89/198 |
| 3,208,175 | 9/1965 | Pisk | 42/1 R |
| 3,610,091 | 10/1971 | Bornand | 42/1 F |
| 3,680,240 | 8/1972 | Barr et al. | 42/1 F |
| 3,952,629 | 4/1976 | Boccarossa et al. | 89/14.4 |
| 3,967,402 | 7/1976 | Cooksey | 42/1 F |
| 4,539,769 | 9/1985 | Stevens et al. | 42/1 A |

FOREIGN PATENT DOCUMENTS

| | | | |
|---|---|---|---|
| 308475 | 10/1920 | Fed. Rep. of Germany | 89/1.3 |
| 1901623 | 10/1969 | Fed. Rep. of Germany | 42/1 F |

*Primary Examiner*—Deborah L. Kyle
*Assistant Examiner*—Michael J. Carone
*Attorney, Agent, or Firm*—Faegre & Benson

[57] ABSTRACT

A grenade launcher and attachment for use on an infantry weapon, such as a rifle. The launcher fires grenades of the type which have a hollow tubular rear chamber slidably mounted on a guide rod and a piston head fitted into the bore of the chamber to seal an explosive charge therein and form an extensible explosion chamber. Locking elements for silently installing the grenade launcher without the use of complex tools are provided. Recoil buffering or compensation is provided to minimize the perceived recoil when grenades or other projectiles are launched from a shoulder held firing position. A detent is provided to secure projectiles on the guide tube until they are fired.

4 Claims, 19 Drawing Figures

14
98
100
102
104
106
108
110
112
114
122
52
94
180
128
66
176
178
156
158
166
64
154
60
142
138
140
144
146
150
148
162
164
152
58
160
168
170
56
172
182
174
136
11a

GRENADE LAUNCHER ATTACHMENT FOR INFANTRY WEAPON

BACKGROUND OF THE INVENTION

This invention relates to a projectile launching attachment for use on an infantry weapon, such as a rifle, to permit the launching or firing of grenades.

Grenade launchers for use on infantry weapons are well known in the prior art. For example, U.S. Pat. No. 3,641,691 shows a grenade launcher with a pivotally mounted barrel supported beneath the normal rifle barrel of an M-16 type weapon. The launcher is intended to fire standard grenades from conventional cartridges.

U.S. Pat. No. 3,534,492 shows a grenade launching attachment for a firearm which is attached to the end of a conventional firearm barrel and propels the grenade with gas pressure from a blank round fired by the firearm.

Yet another approach to launching grenades using conventional infantry weapons is shown in U.S. Pat. No. 3,960,052 which shows a tripod mounted M-16 weapon firing a rocket propelled grenade from the weapon's barrel. The tripod mount utilizes the weapon in a mortar type arrangement where the grenade follows a high arc trajectory, rather than a more direct path, to its target.

None of the existing infantry weapon grenade launching arrangements are suitable for firing projectiles of the type shown in U.S. Pat. No. 3,610,091, for example, where the projectile has a hollow chamber at its rear end which has a propulsive charge loaded at the forward end thereof compressed by a piston which is backed by a guide rod on the launcher extending into the tube. Upon firing, the projectile is rapidly propelled from the guide rod as the projectile is rapidly accelerated relative to the guide rod. Although such projectiles have been utilized in various mortar type launchers where the launcher is supported against a ground surface and the projectile is fired in a high arc trajectory at a target, they have not been successfully shoulder fired.

Because the propulsive charge burns extremely rapidly, the firing of the projectile, including the movement of the piston from the top of the tube to the bottom, occurs in approximately two milliseconds. Because of the relatively high mass of the projectile and its warhead, the momentum transferred to the guide rod is quite large and, given its extremely short transfer time, the high perceived recoil has been unacceptably high, and has heretofore prevented use of this type of projectile in shoulder-fired or direct-held weapons not relying on a high arc trajectory, such as utilized with mortar type weapons.

SUMMARY OF THE INVENTION

The present invention is an infantry weapon attachment for firing ballistic projectiles having a hollow body portion fitting slidably on a guide rod and having a piston head fit in the bore of the hollow body to comprise an extensible explosion chamber in which a propulsive charge is disposed.

The launcher includes a frame which is pivotally connected at one end to the bolts projecting from the sides of the infantry weapon's receiver housing and is adapted at its front end for locking attachment to the bayonet lug of the infantry weapon. The launcher attachment includes a guide rod or spigot slidably mounted within or attached to the launcher frame and projecting forwardly when the launcher attachment is mounted on the infantry weapon. The guide rod is oriented generally parallel to the barrel of the infantry weapon to receive a projectile mounted with a hollow tubular rear chamber in the body of the projectile. The guide rod is movable along its longitudinal axis relative to the launcher frame. The attachment also includes recoil compensation means mounted on the launcher frame for reducing the perceived recoil felt by an infantryman when a projectile is fired from the guide rod. The recoil compensation means is coupled to the guide rod and the launcher frame for distributing the recoil energy of the guide rod over a time interval substantially longer than the time interval required for the projectile piston head to travel the entire bore of the hollow portion as the projectile is fired to thereby reduce the perceived recoil.

DETAILED DESCRIPTION OF THE PREFERRED EMBODIMENTS

Figure 1:
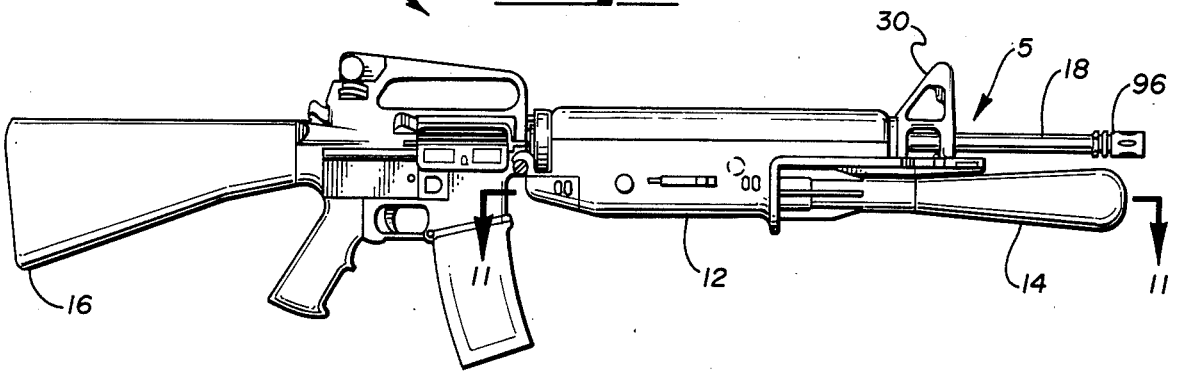
FIG. 1 is a right side elevational view of an infantry weapon with the launcher attachment connected and a projectile loaded.

FIG. 1 shows an infantry weapon 10 upon which the projectile or grenade launcher attachment 12 has been mounted. In the preferred embodiment shown, the infantry weapon is of the type designated by the United States Government M-16A2 which is a reinforced assault rifle capable of automatic and semi-automatic fire. It can be seen that the invention disclosed herein can be adapted for use with other infantry weapons without departing from the invention of the claims. It can also be manufactured as a projectile launcher for shoulder or mortar type firing.

In FIG. 1, a projectile or grenade 14 is shown mounted in the firing position on grenade launcher attachment 12. As will be described in more detail below, launcher attachment 12 can be utilized to fire projectiles 14, either in a high trajectory indirect mode with the butt portion 16 resting on the ground and the barrel 18 of weapon 10 oriented at an angle between approximately 30° and 60° to the ground surface or can be fired in a direct fire mode where the user rests the butt portion of weapon 10 against his shoulder and fires projectile 14 essentially along a line of sight.

Figure 2:
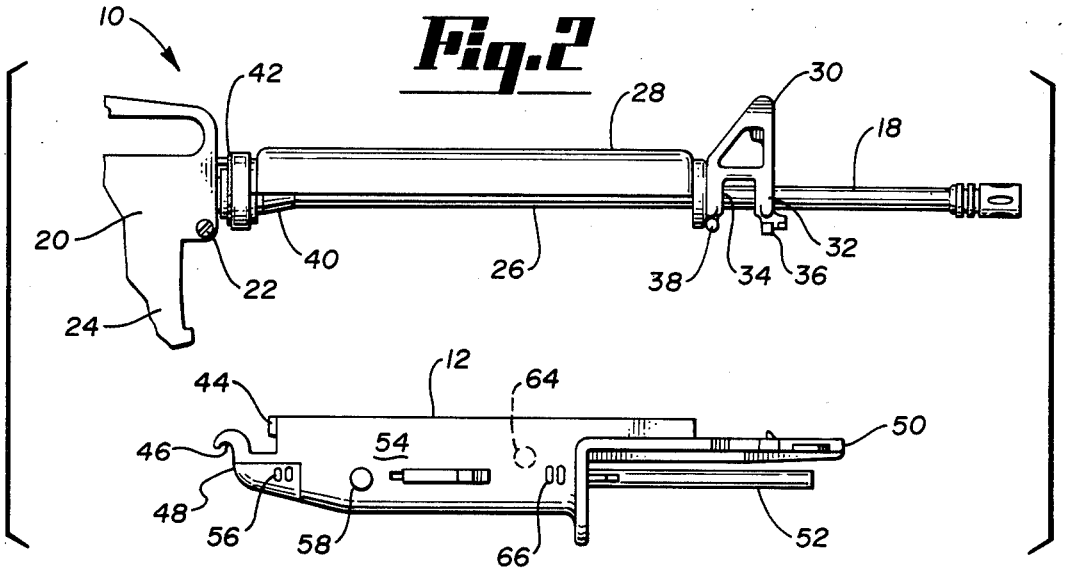
FIG. 2 is a right side elevational view of the infantry weapon with the lower forestock removed and the launcher attachment detached.

The details of attachment of launcher 12 to infantry weapon 10 can be seen in FIG. 2. Launcher 12 is connected at one end to receiver 20. It is directly connected to receiver bolts 22 which are located near the forward extremity of receiver 20 and just above magazine extension 24.

The body of launcher 12 is positioned below the aft position 26 of the barrel which is covered by a top forestock or protective cover 28. Immediately forward of forestock 28 is the original equipment front sight 30. Front sight 30 is attached to forward muzzle portion 18 by a forward support portion 32 and a rear support portion 34. Immediately below forward sight support 32 is a bayonet lug 36. Immediately below rear sight support 34 is a front swivel mount 38.

The distal portion 40 of barrel 26 tapers to a larger diameter where the barrel meets breech 42.

Launcher 12 has a breech butt 44, a pair of hooks 46 which are on opposite sides of receiver 20 and a receiver butt portion 48. It also has a projecting forward tongue portion 50 for engagement with bayonet lug 36 of weapon 10. It also has a guide tube or spigot 52 which projects from housing 54.

Figure 3:
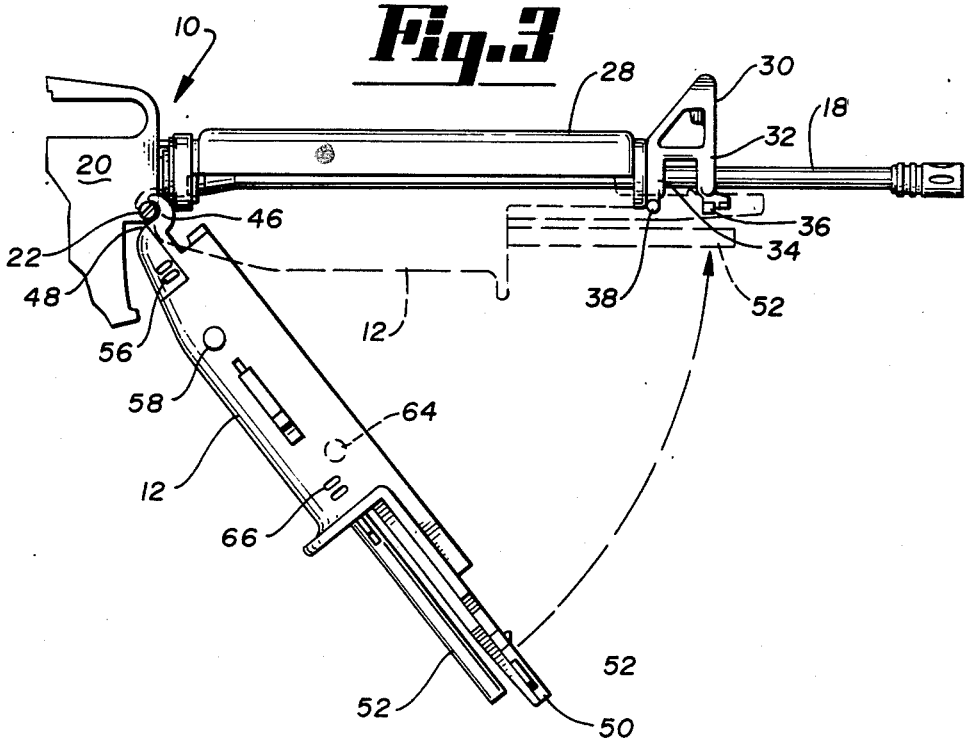
FIG. 3 is a right side elevational view, as in the preceding views, illustrating the attachment procedure.
Figure 4:
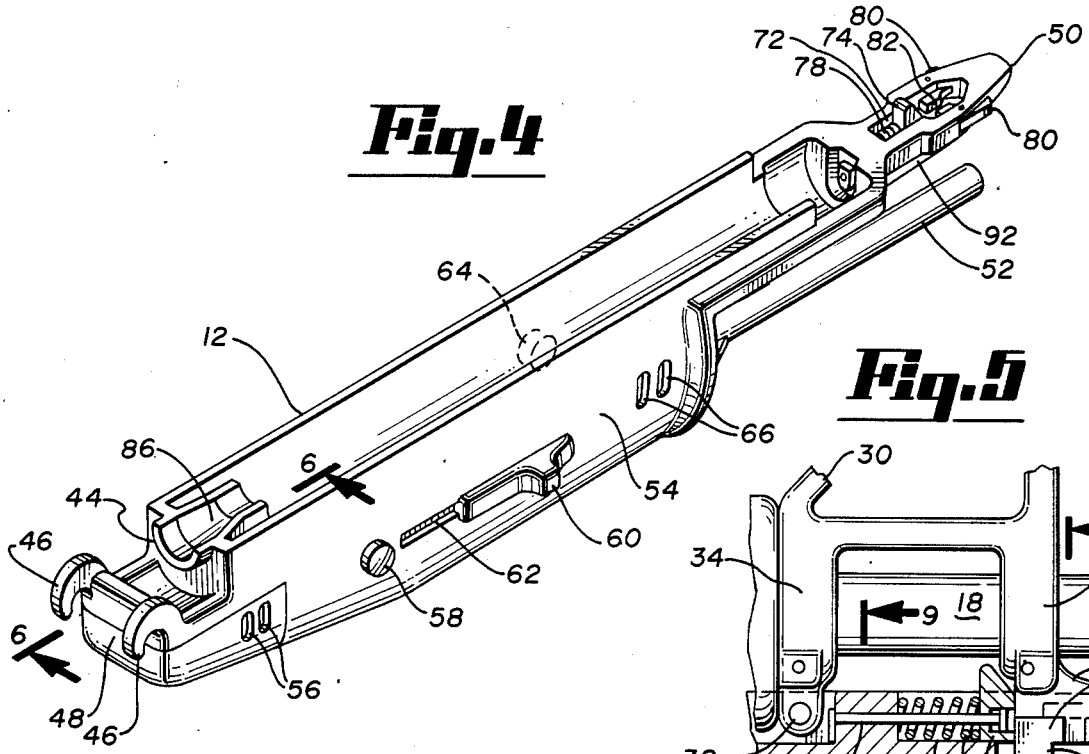
FIG. 4 is a pictorial view of the launching attachment taken from its right side, behind and above.

Housing 54 includes rear vents 56. A mechanical trigger 58 is mounted on the side of housing 54, and a cocking slide 60 is mounted on a track 62 to cock the launching device. FIGS. 3 and 4 show an electrical trigger button 64. A set of forward vents 66 also projects through housing 54.

FIG. 3 shows the procedure for mounting launcher 12 on weapon 10. Hooks 46 are engaged with projecting bolts 22 on receiver 20. If the stock or regular receiver bolts 20 do not project sufficiently from receiver 20 to adequately engage hooks 46, they can be replaced with receiver bolts having a projecting head portion to adequately engage hooks 46. The normal bottom forestock portion is removed from the weapon before launcher 12 is attached. After hooks 46 engage the heads of bolts 22, the launcher can be pivoted from the attaching position shown in FIG. 3 to the fully mounted position shown in phantom outline in FIG. 3.

Figure 5:
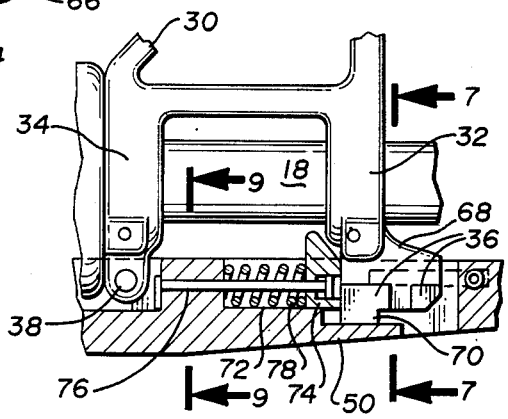
FIG. 5 is a fragmentary right side elevational view in enlarged scale of the front attaching point of the launcher attachment showing the bayonet lug and also showing, in vertical cross-section, the elements of the latch and bias block of the launcher attachment.

The details of the detent or locking mechanism to attach forward tongue portion 50 of launcher 12 to bayonet lug 36 of infantry weapon 10 are shown in FIG. 5.

As can be seen in FIG. 5, bayonet lug 36 is attached to forward support portion 32 by a lug shoe element 68. The bottom of lug 36 has a step 70 which can best be seen in FIGS. 5 and 7.

Forward tongue portion 50 of launcher 12 has an opening 72 which receives bayonet lug 36. At the rear of opening 72 is a bias block 74. Bias block 74 is retained in opening 72 by a retaining rod 76 which is secured to forward tongue portion 50 of launcher 12. A compression spring 78 urges bias block 74 toward the forward end of tongue portion 50 in opening 72. When launcher 12 is pivoted into the fully attached position shown in FIG. 3, bayonet lug 38 enters opening 72 and forces bias block 74 rearwardly in opening 72. Bias block 74 exerts a frictional force tending to secure launcher 12 in the mounted position until the locking mechanism is actuated.

Figure 7:
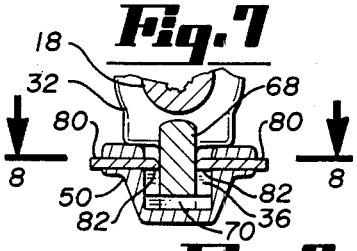
FIG. 7 is a vertical cross-section taken along line 7—7 of FIG. 5.
Figure 8:
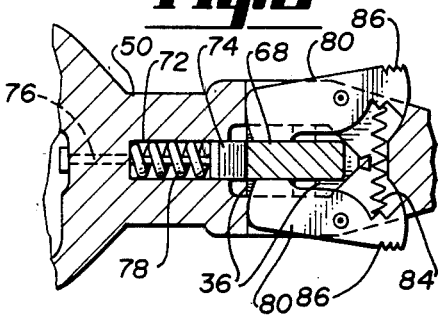
FIG. 8 is a horizontal sectional view of the latch and bias block of the launching attachment taken along line 8—8 of FIG. 7.

The locking mechanism includes a pair of butterfly lock arms 80 which are pivotally mounted to tongue 50 on either side of opening 72. Each butterfly arm 80 has projecting lock portions 82 which grip the sides of bayonet lug shoe 68, as shown in FIGS. 7 and 8, and prevent launcher 12 from being pivoted downwardly past the point where lock portions 82 engage step 70 of bayonet lug 36. Lock portions 82 are biased into their engaged or closed position by a compression spring 84 which urges the actuating portions 86 outwardly to pivot lock portions 82 inwardly against lug shoe 68.

Figure 6:
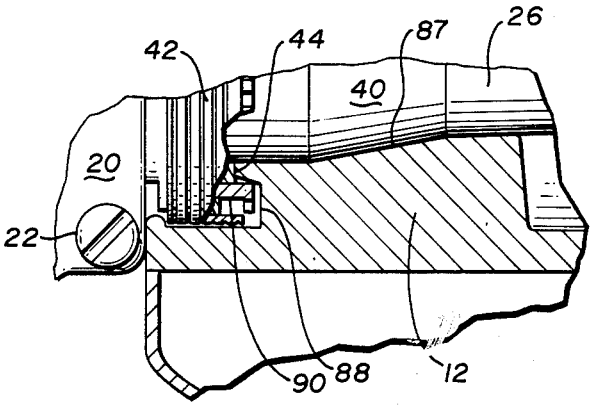
FIG. 6 is a fragmentary right side elevational view in enlarged scale illustrating the rear attachment point of the launcher attachment showing the rifle barrel and receiver in part and also showing, in vertical cross-section, the buttressing elements of the receiver end of the grenade launcher taken along line 6—6 of FIG. 4.

The aft portion of launcher 12 is mounted on weapon 10 as shown in the detailed view in FIG. 6. Breech face 44 of launcher 12 rests against breech 42 of weapon 10. FIG. 4 shows the engaging surface 44 which is part of a nest 87 which has an inside contour matching the interface between barrel portion 26, tapered barrel portion 40 and the breech interface. Thus, the aft portion of launcher 12 fits snugly against the stem of barrel 26 and longitudinally directly abuts breech 42. A slot 88 in housing 54 allows clearance for the attachment element 90 to which the bottom forestock portion is mounted when the launcher attachment 12 has been removed.

Figure 9:
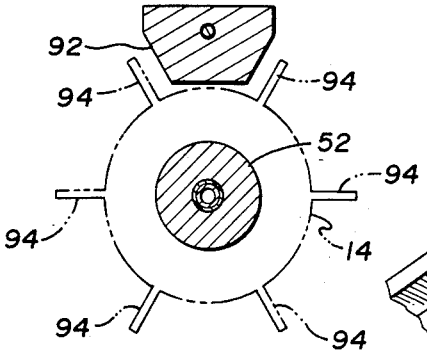
FIG. 9 is a vertical cross-section taken along line 9—9 of FIG. 5 and showing the orientation track with a projectile shown in phantom outline mounted on the guide tube.
Figure 10:
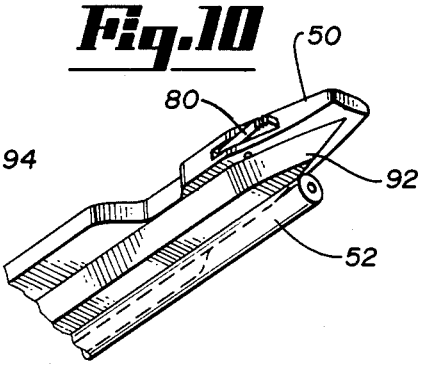
FIG. 10 is a pictorial view of the forward portion of the launcher attachment taken from the right side, ahead and below.

FIG. 9 shows the orientation guide 92 which assists in the proper orientation of projectile 14 as it is loaded onto launcher 12. Orientation track 92 is mounted or formed on the lower side of tongue portion 50 and is aligned with barrel 18 when launcher 12 is attached to weapon 10. It is positioned slightly above and parallel to guide tube 52 so that, when projectile is mounted on the attachment by inserting guide tube 52 into the hollow portion of the body of projectile 14, orientation guide 92 will force the fins 94 of projectile 14 to align themselves on both sides of guide 92. Placing the fins in the orientation shown in FIG. 9 assures that a minimum vertical spacing can be adopted between guide tube 52 and barrel Portion 18 without the possibility of a fin 94 striking barrel 18 or flash suppressor 96.

Figures 11A, 14, 15, 16, 16A, 17:
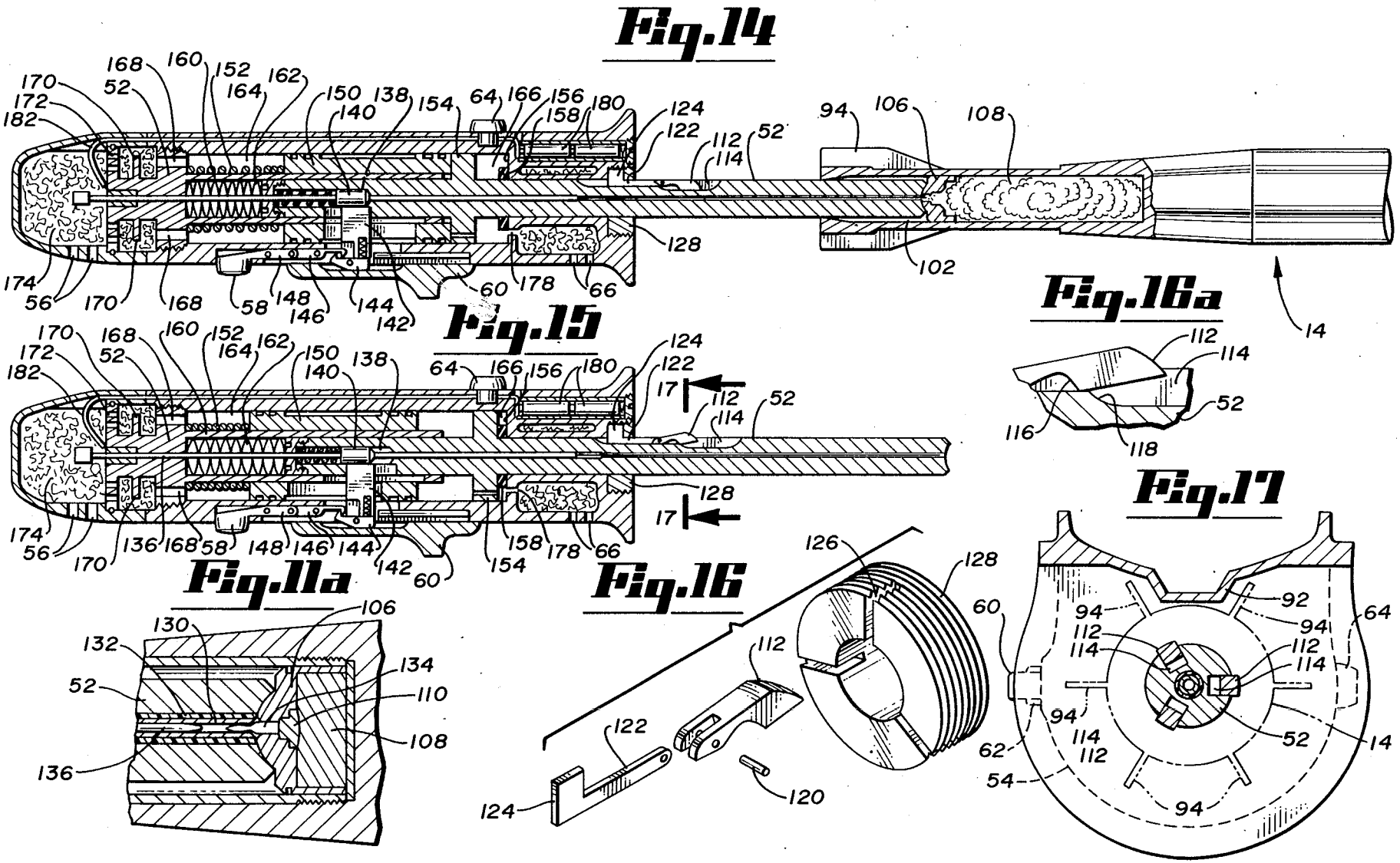
FIG. 11A is a sectional detail in enlarged scale taken at 11A of FIG. 11.
FIG. 14 is a view similar to that of FIG. 11 with the projectile accelerating along the guide tube and the motion of the guide tube bottoming out against the recoil compensating elements.
FIG. 15 is a view similar to that of FIG. 11 with the launcher attachment returned to a cocked position.
FIG. 16 is an exploded view of the representative elements of the projectile detent mechanism.
FIG. 16A is a fragmentary detail taken at 16A of FIG. 11 and is greatly enlarged.
FIG. 17 is a vertical cross-section through the detent taken along line 17—17 of FIG. 15.

FIGS. 11 through 15 illustrate the details of the recoil compensation mechanism of launcher 12, while FIGS. 16 and 17 illustrate the detent mechanism used to secure projectile 14 to guide tube 52 before the projectile is fired.

Projectile 14 is the type of projectile shown in U.S. Pat. No. 3,610,091, for example. It has a warhead portion 98 at its tip and an aerodynamic body 100 and stabilizing fins 94. It has an axial hollowed-out portion 102 which has an internal diameter which exceeds the diameter of guide rod 52 over most of its length. At the exit point at the rear of projectile 14, the hollow portion is constricted to a reduced diameter portion 104, which is substantially equal to the outside diameter of guide tube 52. The forward end of guide tube 52 abuts piston 106 which is slidably mounted at the end of axial hollow portion 102 and encloses or seals a propellant charge 108. A primer 110 is used to ignite propellant charge 108. As charge 108 explodes or rapidly burns, the expanding gases force piston 106 rearwardly in chamber 102, and projectile 14 accelerates rapidly along guide tube 52. When piston 106 reaches constricted portion 104 of hollow chamber 102, it seals the chamber to trap the propellant gases and flames inside projectile 14, and projectile 14 moves on a ballistic path aligned with guide tube 52.

Prior to firing projectile 14, it is secured to guide 52 by latch pawls 112 which are pivotally mounted on guide tube 52 for movement between an unlatched position substantially flush with the outside diameter of guide tube 52 and a latched position where they project above the surface of guide tube 52 and engage the reduced diameter portion 104 of the hollow portion 102 of projectile 14 to prevent inadvertent removal of projectile 14 from guide tube 52 after the projectile is loaded onto launcher 12. In the embodiment shown in the drawings, three latch pawls 112 are disposed around guide tube 52, as shown in FIG. 17.

In FIG. 16A, it can be seen that pawl 112 engages a groove 114 in guide rod 52. The pawl includes a camming surface 116 which cooperates with a similar camming surface 118 of groove 114. When pawl 112 is moved longitudinally to the left from the position in which it is fully inserted in groove 114, the cooperative action of camming surfaces 116 and 118 pivot it clockwise about pivot pin 120 and lift the blade of pawl 112 into an opened or extended position projecting above the surface of guide tube 52.

Figures 11, 12, 13:
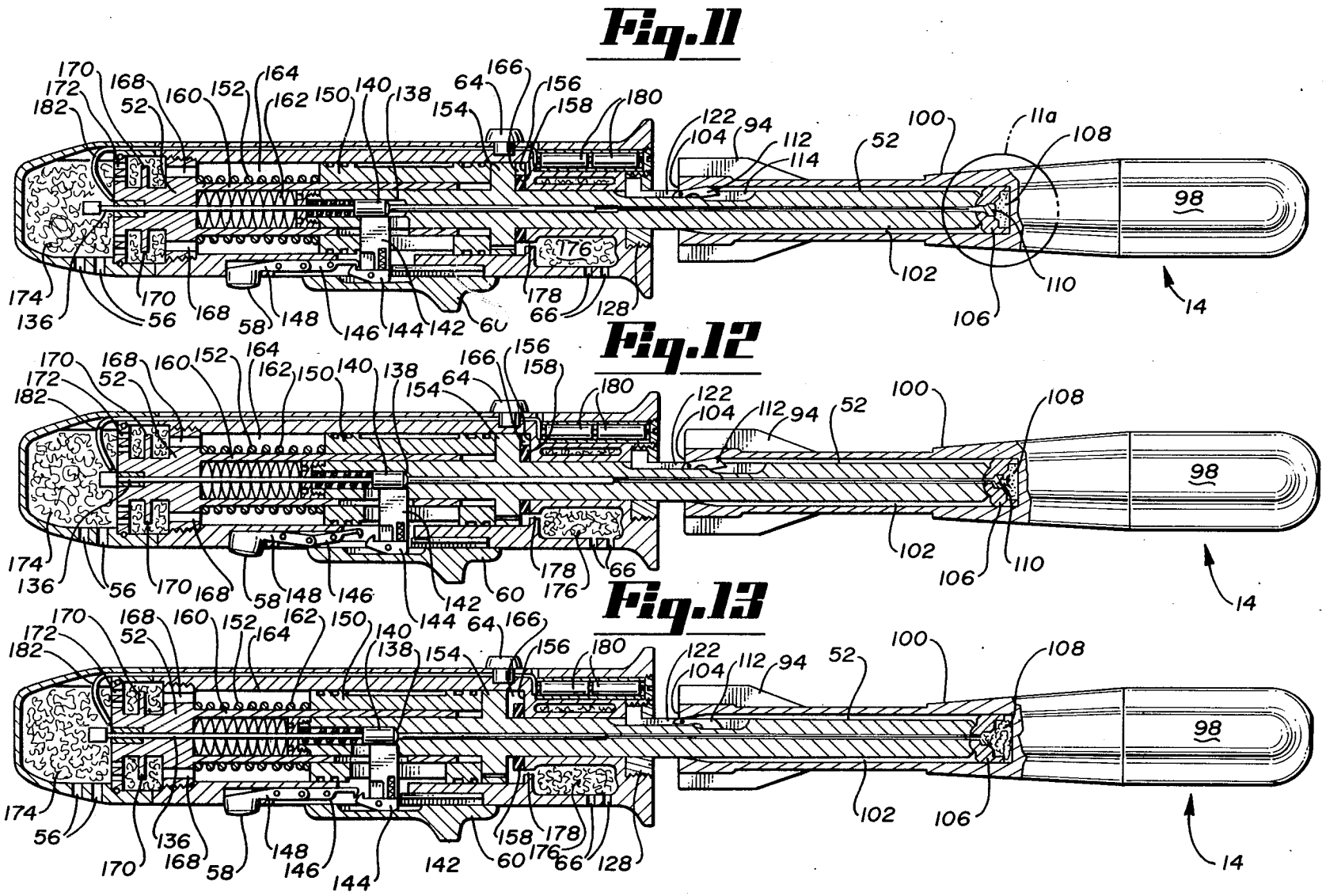
FIG. 11 is a horizontal plan section taken along line 11—11 of FIG. 1 showing the mechanical firing mechanism of the launcher in a cocked position and a projectile set on the guide tube preparatory to launch.
FIG. 12 is a view similar to that of FIG. 11 with the firing pin triggered and the initiating primer detonated.
FIG. 13 is a view similar to that of FIG. 11 with the energy from the piston having driven the guide tube along its longitudinal axis into the launcher frame and having released the projectile holding detent.

Each of the pawls 112 is pivotally connected using pivot pin 120 to the end of an L-member 122 which has a projecting tab 124 which fits into a slot 126 in spanner bushing 128. The exploded view of the pawl 112 and L-member 122 and spanner bushing 128 is shown in FIG. 16. In FIG. 11, the same parts are shown in their installed form in housing 54 of launcher 12. In the position shown in FIG. 11, the detent pawl 112 is in the opened or locking position and withdrawn from groove 114. In the course of the firing process, guide tube 52 moves longitudinally into housing 54 of launcher attachment 12 and groove 114 moves under pawl 112 so that pawl 112 drops into the groove, leaving the outer surface of pawl 112 flush with the wall of guide tube 52 to unlock the projectile from the guide tube, as shown in FIG. 13. A detailed description of the movement of guide tube 52 into housing 54 of launcher attachment 12 is set forth below.

The firing of the projectile occurs when propellant charge 108 is ignited. This ignition can be achieved by either actuating the mechanical trigger 58 or the electrical trigger 64. When the electrical trigger 64 is utilized, an electric potential is applied to a tubular electrical conductor 130 which forms an inner lumen of the guide tube 52 and is insulated from the majority of the rod of the guide tube by an insulating jacket 132 coaxial to tube 130 and guide tube 52. If electrical firing is to be initiated, an electrical potential is applied between conductor 130 and the body of guide tube 52. Electrical connector 130 is electrically connected to the outside of electrical connector 134 which is in contact with primer 110. The portion of electrical connector 134 which is in contact with piston 106 is insulated. Thus, the portion of primer 110 which is in contact with electrical connector 134 is at one potential, while the case of primer 110 is in contact with piston 106 and thence to the body of guide tube 52. The primer can thus be fired electrically to initiate the ignition of the propellant charge 108.

Ignition of propellant charge 108 can also be initiated mechanically by driving firing pin 136 through the lumen in conductor 130 against electrical connector 134 and forcing that element against primer 110 which also serves as a percussion initiated primer to ignite propellant charge 108.

When the propellant is initiated and the parts are in the relationship shown in FIG. 11, piston 106 begins to move to the left as propellant 108 rapidly burns. Since the projectile at this point is firmly held by detents 112, the only element capable of movement to permit piston 106 to continue to move is guide tube 52 which moves to the left and into housing 54 of launcher 12. As guide tube 52 moves to the left, the detents are released and the movement of piston 106 against guide tube 52 rapidly propels projectile 14 from the end of guide tube 52 and into ballistic flight.

Guide tube 52 is mounted for a limited degree of longitudinal movement relative to housing 54. Recoil compensating means contained within housing 54 restrain the longitudinal movement of guide tube 52 and spread the inertial impulse over an extended time period to reduce the perceived recoil felt by a user firing the weapon with only shoulder support.

The mechanical triggering of the weapon is accomplished by moving the firing pin which traverses the entire central core of guide tube 52 so that it strikes electrical connector 134 and drives it into percussion primer 110. The pin is driven forwardly by a spring 136 enclosed within a chamber 138 which extends axially along a portion of the length of guide tube 52. Spring 136 bears on a projecting cylindrical member 140 which is axially movable within chamber 138. A projection 142 of member 140 depends downwardly and projects through slot 62 through housing 54. A pivotally mounted sear 144 is connected to projection 142 and is held in place by a pivotally mounted pawl 146 which is, in turn, pivotally connected to a pivotally mounted trigger 148 which has a projecting button 58. Depressing trigger button 58 pivots trigger link 148 about its pivot point and moves the left projection of pawl 146 downwardly to lift the right hook portion of pawl 146 from sear 144 allowing compression spring 136 to drive projection 140 and firing pin 136 to the right to ignite percussion primer 110. Various safety mechanisms can be provided to avoid inadvertent firing of the weapon by depressing trigger button 58.

Guide tube 52 is normally biased into the position shown in FIG. 11 by a sleeve 150 which is urged by a compression spring 152 against a projecting shoulder 154 of guide tube 52. Shoulder 154 is cushioned from an interior shoulder 156 of housing 56 by a rubber cushion 158. Guide tube 52 is also supported for longitudinal movement within housing 52 by an elongated cup 160 which serves as a guide to stabilize guide tube 52 and allow only axial movement thereof. Axial movement of guide tube 52 to the left in housing 52 is restricted by a spring mechanism 162 which abuts the proximal end of guide tube 52 and interconnects it to the solid portion of housing 52 which forms the base for cup 160. In a preferred embodiment, the spring means can be a series of washers in an arrangement known as a Belleville spring which provides an extremely high spring rate to restrain movement of guide tube 52 into housing 54. Other spring elements than Belleville springs can be utilized to provide a similar damping force to guide tube 52.

In addition to restraining movement of guide tube 52 into housing 54 by means of springs 162 and the springs 152 which force recoil sleeve 150 into contact with shoulders 154, additional restraint on the movement of guide tube 52 is provided by the piston action of recoil sleeve 150 between the inner wall of housing 52 and the outer wall of cup 160. A compression chamber 164 is formed to the left of recoil sleeve 150, while an expansion chamber 166 is formed to the right of shoulder 154 which also acts as a cylinder in the chamber formed by the inside wall of housing 52. A vent for the forward compression chamber 164 is provided by vent holes 168 which, in turn, pass through a primary muffler 170 which may be packed with material, such as glass or steel wool, to restrict the flow of compressed gas through the muffler and reduce the noise transmitted therethrough. Muffler 170 is then vented through vents 172 into a secondary or rear muffler 174 and then vented through rear vents 56 to the atmosphere. Thus, guide tube 52 and recoil sleeve 150 move against the spring force of spring 152 and the pneumatic force caused by the restriction of vents 168 and 172 and muffler 170 on the flow of air from compression chamber 164 to restrain movement of guide tube 52.

In an analogous manner, the air entering expansion chamber 166 through forward vents 66, a front muffler 176 and vents 178 also restricts the movement of guide tube 52 and provides a restraint in damping on the movement of that tube. The damping characteristics of both pneumatic elements can be varied by varying the relative sizes of the compression chamber 164 and expansion chamber 166 and their associated vents and muffler. It can also be seen that manufacturing recoil sleeve 150 from a massive material, such as brass, will also increase the interial load which must be overcome to move guide tube 52 further into housing 54.

The various steps in the firing sequence are illustrated in FIGS. 11 through 15. If electrical initiation of the projectile is desired, switch 64 is depressed to connect voltage from batteries 180 through an insulated conductor 182 to the aft end of firing pin 136 which is then energized and positive voltage is applied to primer 110, while the other connection is made through the case of primer 110, the body of projectile 14 and the case of housing 122. As previously described, pressing mechanical trigger 58 moves firing pin 136 forward into percussion cap 110 to ignite the charge.

In FIG. 12, the firing pin is shown moved into its forward position to detonate primer 110 and all of the other elements remain in their initial positions. In FIG. 13, guide tube 52 has moved rearwardly sufficiently to release latch pawls 112 to permit projectile 14 to begin to move along guide tube 52. The transfer of momentum from the projectile to guide tube 52 begins the recoil process, and guide tube 52 begins to move longitudinally into housing 54, beginning to form a partial vacuum behind shoulder 154 of guide tube 52 in expansion chamber 166 and to form a compression in compression chamber 164. Springs 152 and 162 are also beginning their compression cycle to dissipate the energy being imparted to guide tube 52 by projectile 14.

In FIG. 14, the projectile has moved nearly to the end of guide tube 52. The burning of the propellant in the axial hollow portion 102 of projectile 14 is totally enclosed by piston 106 so that the projectile has no smoke, light or even sound signature as it is fired. The guide tube 52 has moved to substantially the full extent of its travel rearwardly into housing 54 and the movement of that tube and firing pin 136 has brought sear 144 into locking engagement with the hook end of pawl 146 to recock the firing mechanism. Inertia from guide tube 52 has been transferred to recoil sleeve 150 and energy has been transferred into the compression of spring 152 and the Belleville springs 162, as well as into the compression in compression chamber 164 and the pulling of a partial vacuum in expansion chamber 166.

In FIG. 15, the final firing stage is shown where guide tube 52 has moved back to the right and shoulder 154 has seated against rubber cushion 158. Vents 56 have allowed ambient air through the rear muffler and primary muffler into compression chamber 164. Air has also been allowed to escape through vents 66 through muffler 176 and expansion chamber 166. The pneumatic damping allows the return of guide tube 52 to its initial position with a minimum of shock and noise.

Using the recoil compensation techniques shown in the preferred embodiment of the launcher attachment, it is believed that the two millisecond impulse which occurs from the rapid launching of projectile 14 from guide tube 52 can be spread into a 20 millisecond or longer force to greatly reduce the perceived recoil felt by a person firing the weapon from the shoulder in a direct launch mode. The attachment thus provides a method for shoulder firing of projectiles previously considered suitable for firing only with indirect or mortar type launchers.

I wish it to be understood that I do not desire to be limited to the exact details of the construction shown and described, for obvious modifications will occur to a person skilled in the art.

I claim:

1. In combination with an infantry weapon having a bayonet lug mounted near the distal end of its barrel and projecting receiver bolts positioned at the forward portion of the rifle receiver on opposite sides thereof, a projectile launcher for firing individual projectile rounds comprising, in combination:

(a) a launcher body;

(b) a pair of hooklike projecting elements attached at one end of the launcher body for engagement of the projecting bolts on the rifle receiver to permit purely pivotal movement of the launcher body about the projecting bolts relative to the barrel of the infantry weapon and removal from the rifle without the use of tools when the launcher body is pivoted about the receiver bolts;

(c) a projecting tongue portion attached to the first end of the launcher and having locking means disposed thereon for engagement with the bayonet lug of the infantry weapon when the launcher body is pivoted about the receiver bolts into a position with the launcher body parallel to the barrel of the weapon;

(d) an opening in the projecting tongue portion positioned to receive the bayonet lug when the launcher body is pivoted into position parallel to the barrel; and (e) pivotally movable engaging means including actuating arms and clamping jaws mounted on both sides of the opening constructed and arranged when actuated to open the jaws to allow insertion of the bayonet lug along an axis perpendicular to the longitudinal axis of the barrel into the opening and when not actuated to engage the step of the bayonet lug and resist pivotal movement of the launcher body away from parallel alignment with the barrel of the infantry weapon by interference with the widened step of the bayonet lug with the engaging means.

2. The invention of claim 1 wherein the pivotally movable engaging means includes locking means constructed and arranged for actuation by squeezing the actuating arms with thumb and forefinger pressure while the launcher body is pivoted into position parallel to the barrel of the weapon.

3. The invention of claim 1 wherein the engaging means also comprises:

(c) bias block means mounted in the opening of the projecting tongue portion;

(d) rod means mounted in the tongue portion and operatively coupled to the bias block means for retaining the bias block in the opening;

(e) spring means mounted in the opening for exerting a spring force on the bias block urging it into frictional contact with the bayonet lug as the launcher body is pivoted into a position parallel to the barrel of the infantry weapon.

4. The invention of claim 3 wherein the bias block has a camming surface constructed and arranged for engagement with the bayonet lug and for moving the bias block against the force of the spring means as the launcher body is pivoted into a position parallel to the barrel of the infantry weapon.

* * * * *